US007905711B2

(12) United States Patent
Mochizuki et al.

(10) Patent No.: US 7,905,711 B2
(45) Date of Patent: Mar. 15, 2011

(54) MULTIPLE PUMP UNIT

(75) Inventors: Yasuhisa Mochizuki, Hyogo (JP); Ryota Ohashi, Hyogo (JP)

(73) Assignee: Kanzaki Kokyukoki Mfg. Co., Ltd., Hyogo (JP)

( * ) Notice: Subject to any disclaimer, the term of this patent is extended or adjusted under 35 U.S.C. 154(b) by 825 days.

(21) Appl. No.: 11/781,510

(22) Filed: Jul. 23, 2007

(65) Prior Publication Data

US 2008/0019843 A1 Jan. 24, 2008

(30) Foreign Application Priority Data

Jul. 24, 2006 (JP) ..... 2006-200186

(51) Int. Cl.
*F04B 1/12* (2006.01)
*F04B 27/08* (2006.01)

(52) U.S. Cl. ..... 417/269; 91/499; 60/464; 60/488

(58) Field of Classification Search ..... 417/269; 91/499; 60/464, 488
See application file for complete search history.

(56) References Cited

U.S. PATENT DOCUMENTS 2,769,393 A * 11/1956 Cardillo et al. ..... 417/203
3,066,609 A * 12/1962 Hann ..... 417/206
5,311,740 A * 5/1994 Shiba et al. ..... 60/453
5,354,180 A * 10/1994 Forster ..... 417/199.1
5,782,161 A * 7/1998 Okubo et al. ..... 92/71
6,332,393 B1 * 12/2001 Trimble ..... 92/12.2
2005/0053478 A1 * 3/2005 Sakikawa et al. ..... 417/269
2005/0226747 A1 * 10/2005 Ohashi et al. ..... 417/434

FOREIGN PATENT DOCUMENTS

JP 3781899 3/2006
JP 3781899 * 5/2006

* cited by examiner

*Primary Examiner* — Devon C Kramer
*Assistant Examiner* — Peter J Bertheaud
(74) *Attorney, Agent, or Firm* — Sterne, Kessler, Goldstein, & Fox P.L.L.C.

(57) ABSTRACT

There is provided a multiple pump unit including a pump shaft, a first pump, a pump housing, a second pump and a fluid passage block connected to one end surface in an axis line direction of the pump housing. One or both contacting surfaces of the pump housing and the fluid passage block is formed with a concave portion for accommodating the second pump. The pump housing is provided with a suction fluid passage guiding hydraulic fluid to a suction opening of the first pump and a first pump discharge fluid passage having a distal end that forms a first pump discharge port. The fluid passage block is provided with a second pump discharge port having the second pump as a hydraulic source.

10 Claims, 14 Drawing Sheets

MULTIPLE PUMP UNIT

BACKGROUND OF THE INVENTION

1. Field of the Invention

The present invention relates to a multiple pump unit in which a plurality of pumps is arranged in series.

2. Background Art

A multiple pump unit in which a plurality of pumps is arranged in series is widely used as a hydraulic source for operating various actuators in a construction machine and the like.

Japanese Patent No. 3781899, for instance, proposes a multiple pump unit in which a piston pump, a trochoid pump, and a gear pump are coaxially arranged in series.

Specifically, the conventional multiple pump unit includes a pump shaft, a piston pump rotated about an axis line by the pump shaft, a housing main body having an opening that is sized to allow the piston pump to pass therethrough, a port block connected to the housing main body so as to close the opening with the piston pump accommodated in the housing main body, an auxiliary pump shaft connected to the pump shaft in a non-rotatable manner about an axis line, a trochoid pump accommodated in a concave portion formed in the port block and rotated by the auxiliary pump shaft, a gear pump rotated by the auxiliary pump shaft, and a gear pump case connected to the port block so as to surround the gear pump.

Such a multiple pump unit has an advantage that discharged fluids from the piston pump, the trochoid pump, and the gear pump can be independently used in various applications, but has several drawbacks.

For example, the number of pumps to be provided in the multiple pump unit and the number of discharge ports fluidly connected to the pumps functioning as the hydraulic source differ depending on the application to which the multiple pump unit is applied.

That is, in some cases, the piston pump, the trochoid pump and the gear pump all need to be provided, while in other cases, only the piston pump and the gear pump are sufficient to be provided depending on the application.

The number of actuators operated by hydraulic pressure from the trochoid pump also differs depending on the application.

Thus, the number of pumps to be provided and the preferred number of discharge ports for discharging hydraulic pressure from one pump to outside differ according to necessity and/or a specification, but the multiple pump unit described in the above patent document cannot correspond to such various specifications unless the port block itself is replaced.

Furthermore, there is no multiple pump unit, which includes the plurality of pumps, capable of enhancing piping workability of connecting conduits to suction fluid passages and discharge fluid passages of the plurality of pumps.

BRIEF SUMMARY OF THE INVENTION

In view of the conventional art, it is one object of the present invention to provide a multiple pump unit in which a first and a second pump are arranged in series along an axis line direction of a pump shaft, the multiple pump unit capable of easily changing specification to a mode in which the second pump is not provided and to a mode in which the number of discharge ports having the second pump as a hydraulic source is differed, while using a pump housing accommodating the first pump as it is.

It is another object of the present invention to provide a multiple pump unit, which includes the plurality of pumps, capable of enhancing piping workability of connecting conduits to suction fluid passages and discharge fluid passages of the plurality of pumps.

The present invention provides, in order to achieve the first object, a multiple pump unit including a pump shaft operatively connected to a driving power source, a first pump driven by the pump shaft, a pump housing for accommodating the first pump, and a second pump operatively driven by the pump shaft, the multiple pump unit further including a fluid passage block connected to one end surface in an axis line direction of the pump housing. One or both contacting surfaces of the pump housing and the fluid passage block is formed with a concave portion for accommodating the second pump. The pump housing is provided with a suction fluid passage having a first end opened to an outer surface to form a suction port, the suction fluid passage guiding hydraulic fluid, which has been introduced through the suction port, to a suction opening of the first pump, and a first pump discharge fluid passage having a proximal end fluidly connected to a discharge opening of the first pump and a distal end opened to an outer surface to faun a first pump discharge port. The fluid passage block is provided with a second pump discharge port having the second pump as a hydraulic source.

In the multiple pump unit according to the present invention, it is possible to easily change specification between one mode where the second pump 40 is provided and the other mode where the second pump is omitted.

Preferably, the fluid passage block may be provided with a plurality of the second pump discharge ports, and valves for controlling discharge states of the plurality of second pump discharge ports may be mounted to the fluid passage block.

More preferably, the plurality of second pump discharge ports may be provided on the same surface of the fluid passage block.

In one embodiment, the fluid passage block integrally includes a contacting portion contacting the pump housing and an extending portion extending radially outward from the contacting portion with the axis line of the pump shaft as the reference, and the valves are mounted to the extending portion.

In one embodiment, the fluid passage block preferably includes a valve block detachably connected to an end surface facing a direction parallel to the axis line of the pump shaft of the extending portion, and the valves are mounted to the valve block.

In another embodiment, the fluid passage block includes a fluid passage plate contacting the pump housing, and a valve block which is detachably connected to an end surface facing a direction orthogonal to the axis line of the pump shaft of the fluid passage plate and to which the valves are mounted.

In the above various configurations, the suction fluid passage is preferably configured to guide operation fluid, which has been sucked through the suction port, to a first suction opening on a side close to the first pump of the second pump as well as to the suction opening of the first pump.

Preferably, the multiple pump unit further includes a third pump arranged on a side opposite to the first pump in the axis line of the pump shaft with the second pump as a reference, the third pump being operatively driven by the pump shaft, and a third pump housing connected to an outer surface of the fluid passage block so as to surround the third pump. The suction fluid passage includes a third pump branched fluid passage for guiding hydraulic fluid, which has been introduced through the suction port, to a contacting surface with the fluid passage block. The third pump housing is provided with a third pump suction fluid passage having a first end opened to a contacting surface with the fluid passage block and a second end fluidly connected to a suction opening of the third pump, and a third pump discharge fluid passage having a first end fluidly connected to a discharge opening of the third pump and a second end opened to an outer surface to form a third pump discharge port. The fluid passage block is formed with a communication passage for fluidly connecting the third pump branched fluid passage to a second suction opening on a side opposite to the first suction opening in the axis line of the pump shaft of the second pump and the third pump suction fluid passage.

More preferably, the first pump discharge port, the second pump discharge port and the third pump discharge port are arranged on a same surface side of the multiple pump unit.

More preferably, at least a part of the concave portion is formed in the pump housing, and the first end of the third pump suction fluid passage is arranged so as to overlap at least one of the concave portion and the second end of the third pump branched fluid passage when seen along the axis line direction of the pump shaft.

Preferably, the first pump may include a cylinder block supported by the pump shaft in a relatively non-rotatable manner about the axis line, a plurality of pistons accommodated in the cylinder block in a slidable manner along the axis line, a movable swash plate capable of swinging about a swing axis orthogonal to the pump shaft so as to change sliding ranges of the plurality of pistons according to its tilted position about the swing axis, and a biasing member for biasing the movable swash plate towards a maximum tilted direction about the swing axis. The biasing member is accommodated in the pump housing so as to be substantially in parallel to the pump shaft with its distal end operatively engaged to the movable swash plate. The fluid passage block is provided with a manual operation member for changing a position of a proximal end of the biasing member.

More preferably, discharge pressure of the third pump acts on the movable swash plate so as to tilt the movable swash plate towards a neutral side about the swing axis against the biasing force of the biasing member.

Further, the present invention provides, in order to achieve another object, a multiple pump unit including a plurality of pumps directly or indirectly driven by a pump shaft that is operatively connected to a driving power source, the multiple pump unit further including a suction fluid passage having a first end opened to an outer surface to form a single suction port and second ends branched so as to be fluidly connected to suction openings of the plurality of pumps, respectively, and a plurality of discharge fluid passage having first ends respectively fluidly connected to discharge openings of the plurality of pumps and second ends opened to an outer surface to respectively form a plurality of discharge ports. The plurality of discharge ports face the same direction.

BRIEF DESCRIPTION OF THE DRAWINGS

The invention, together with objects and advantages thereof, may best be understood by reference to the following description of the presently preferred embodiments together with the accompanying drawings.

DETAILED DESCRIPTION OF THE INVENTION

First Embodiment

One embodiment of a multiple pump unit according to the present invention will now be described with reference to the accompanying drawings.

The multiple pump unit includes a plurality of pumps driven by a single drive shaft or a plurality of drive shafts arranged coaxially to each other, and is configured so as to independently supply hydraulic pressure from the plurality of pumps to hydraulic actuators.

Figure 1:
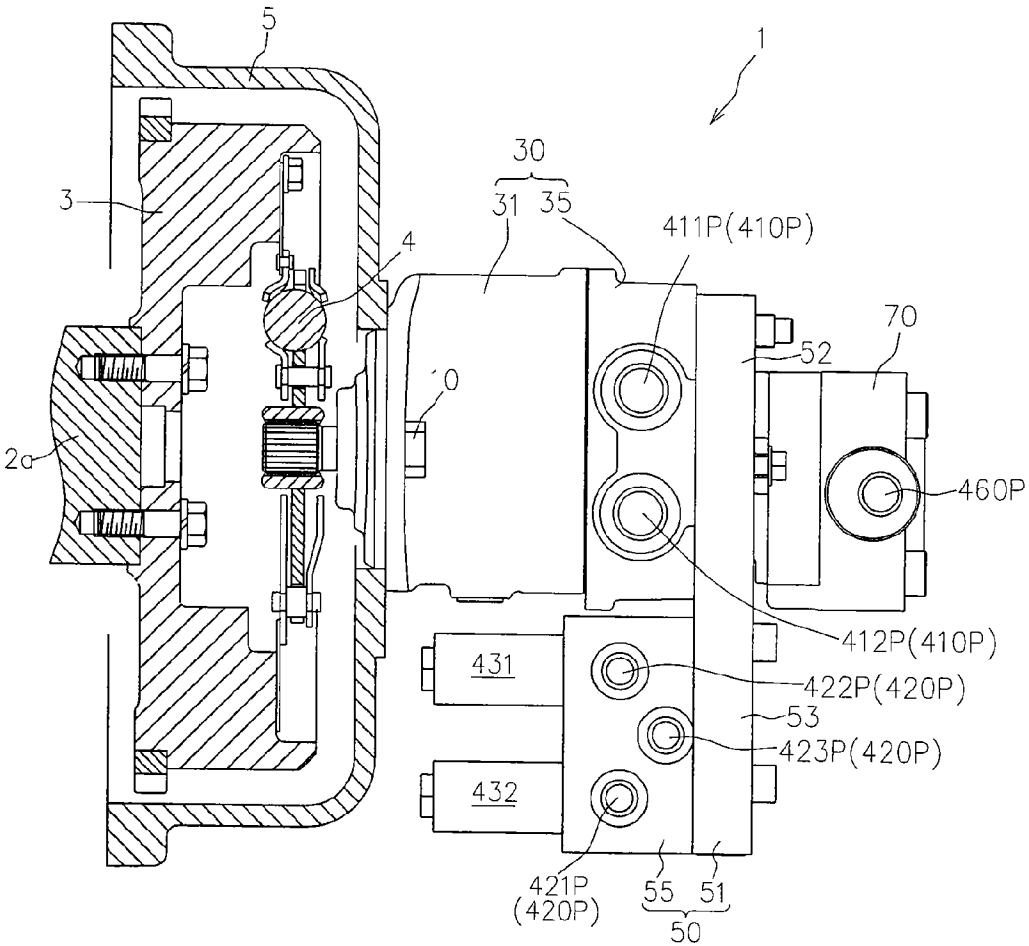
FIG. 1 is an outline view of a multiple pump unit according to a first embodiment of the present invention.

FIG. 1 shows an outline view of a multiple pump unit 1 according to the present embodiment.

Figure 2:
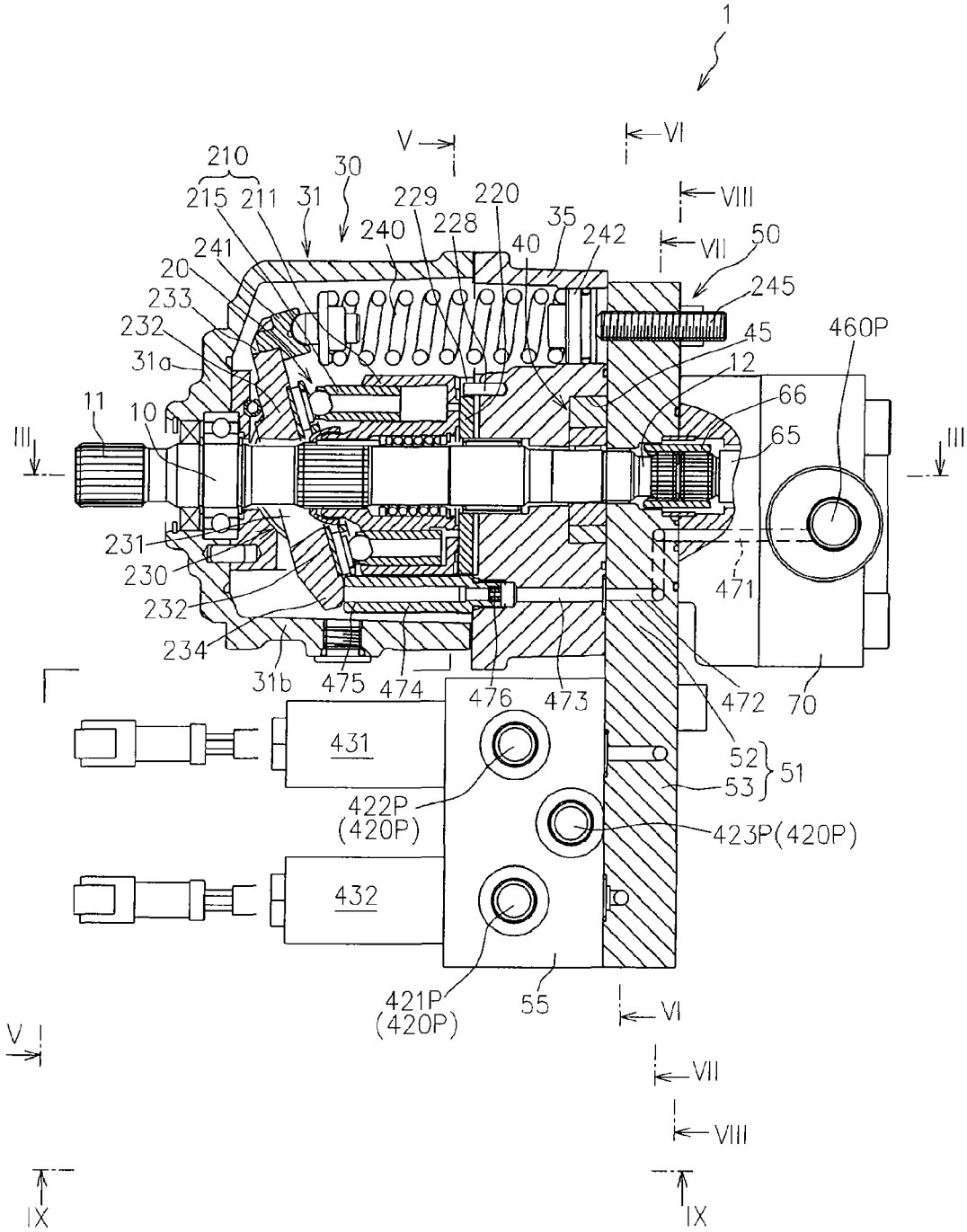
FIG. 2 is a cross sectional view of the multiple pump unit shown in FIG. 1.
Figure 3:
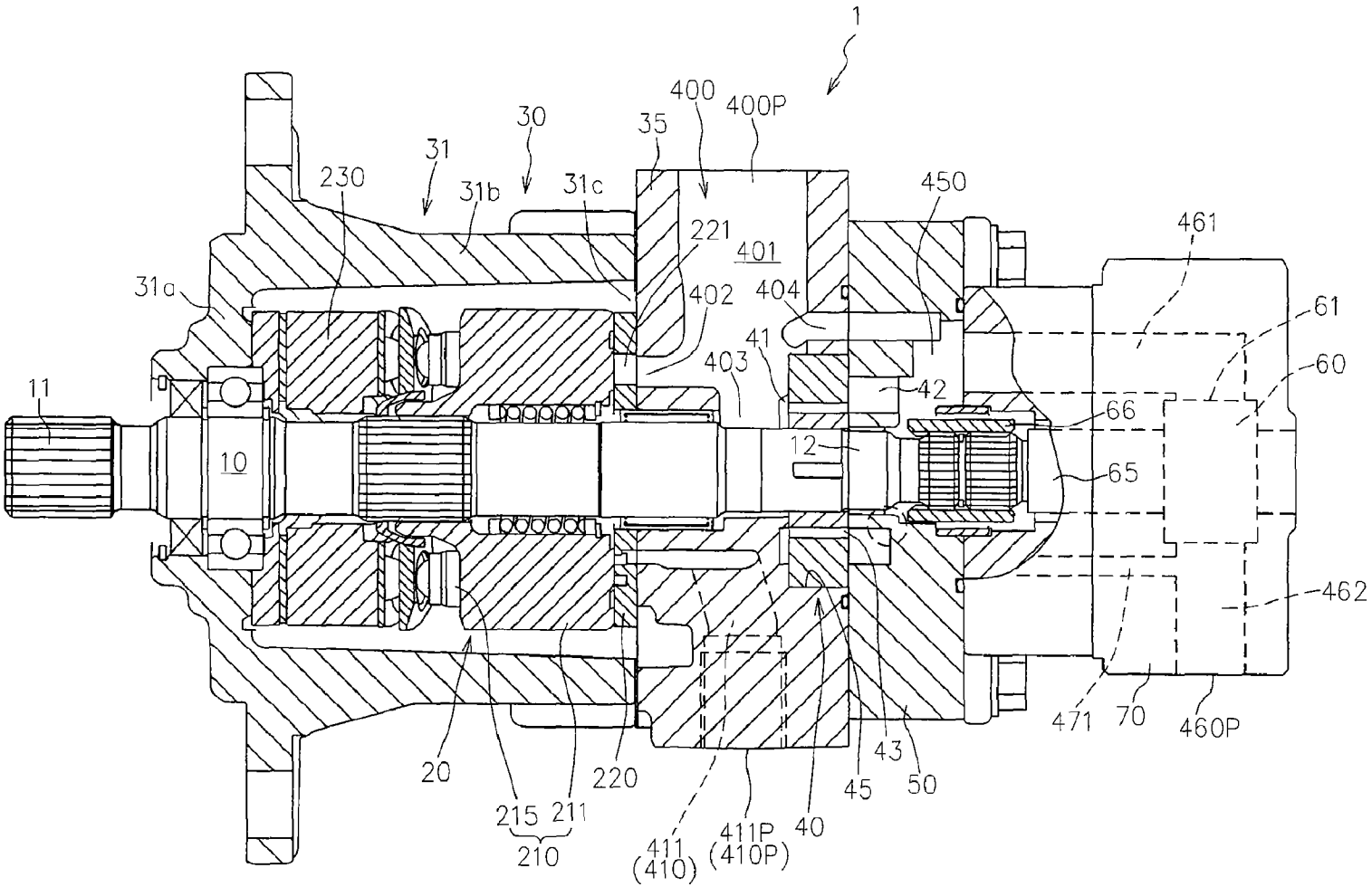
FIG. 3 is a cross sectional view taken along line of FIG. 2.

FIGS. 2 and 3 show cross sectional views of the multiple pump unit 1, FIG. 3 showing the cross section taken along line of FIG. 2.

Figure 4:
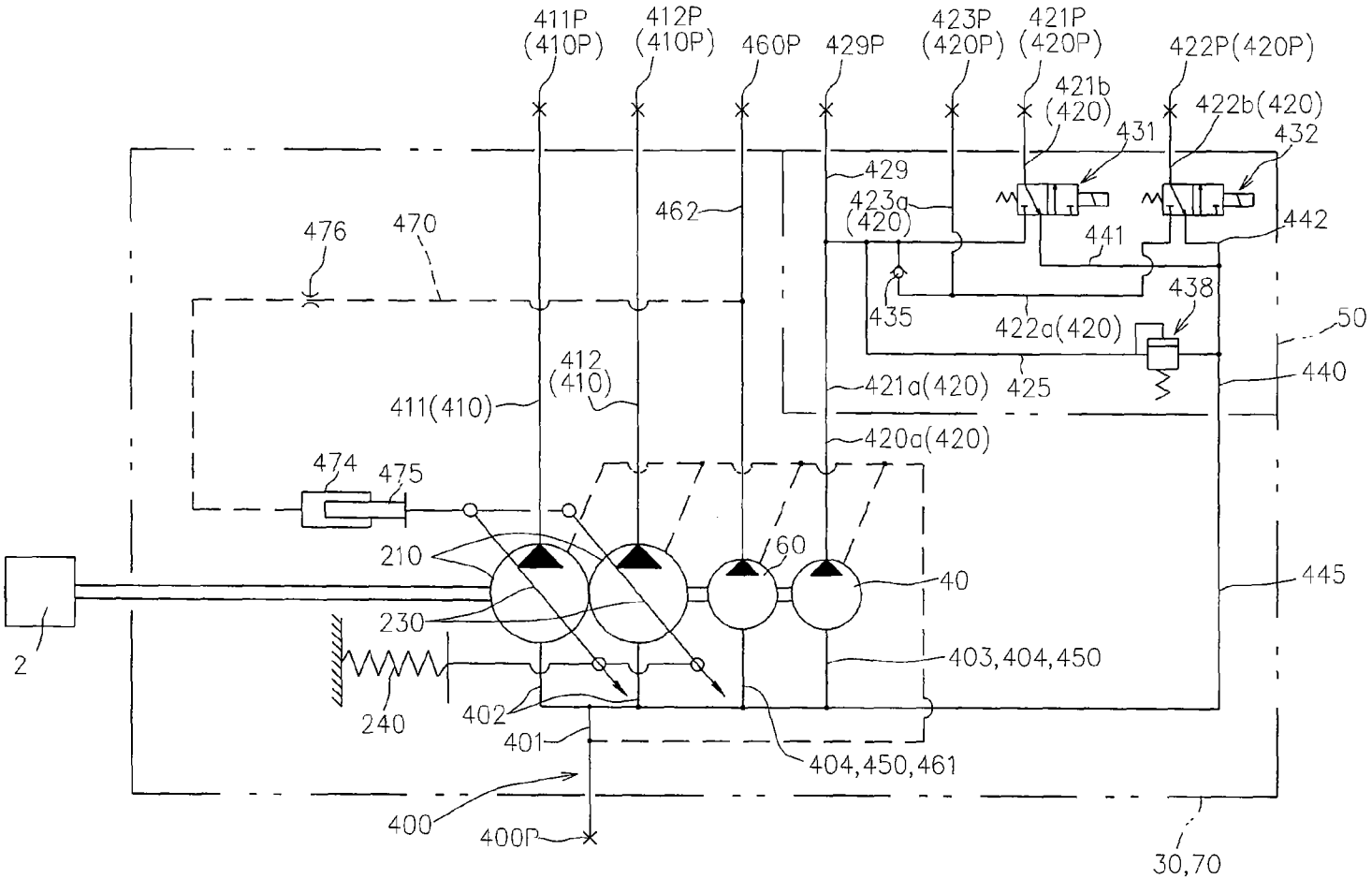
FIG. 4 is a hydraulic circuit view of the multiple pump unit shown in FIGS. 1-3.

FIG. 4 shows a hydraulic circuit view of the multiple pump unit 1.

In the present embodiment, the multiple pump unit includes a first to a third pumps.

Specifically, as shown in FIGS. 1 to 4, the multiple pump unit 1 includes a pump shaft 10 operatively connected to a driving power source 2 (see FIG. 4), a piston pump 20 rotatably driven by the pump shaft 10, the piston pump 20 serving as the first pump, a pump housing 30 for accommodating the piston pump 20, a trochoid pump 40 serving as the second pump, a fluid passage block 50 connected to the pump housing 30, a gear pump 60 serving as the third pump, and a gear pump case 70 connected to the fluid passage block 50 so as to surround the gear pump 60.

As shown in FIGS. 1 to 3, the pump shaft 10 is supported by the pump housing 30 in a rotatable manner about the axis line with a first end 11 that forms an input end extending outward from the pump housing 30.

In the present embodiment, the first end 11 of the pump shaft 10 is connected to an output shaft 2*a* of the driving power source 2 by way of a flywheel 3 and a damper 4 (see FIG. 1).

Further, in the present embodiment, the pump shaft 10 has a second end 12 on a side opposite to the first end 11, the second end 12 also extending outward from the pump housing 30 (see FIGS. 2 and 3).

The pump housing 30 includes a housing main body 31 provided with an opening 31*c*, which is sized to allow the piston pump 20 to pass therethrough, at one end side in the axis line direction, and a port block 35 connected to the housing main body 31 so as to close the opening 31*c*.

The housing main body 31 has a first end wall 31*a* extending in a direction orthogonal to the pump shaft 10 and configured to allow the first end 11 of the pump shaft 10 to pass therethrough, and a peripheral wall 31*b* extending from a peripheral edge of the first end wall 31*a* to the one end side in the axis line direction, the peripheral wall 31*b* having the opening 31*c* on the one end side in the axis line direction.

In the present embodiment, as shown in FIG. 1, the first end wall 31*a* of the housing main body 31 is connected to a flywheel housing 5 supported by the driving power source 2 so as to surround the flywheel 3, and thus the multiple pump unit 1 is supported by the driving power source 2.

The port block 35 is removably connected to the housing main body 31 so as to close the opening 31*c* to form a piston pump accommodating space for accommodating the piston pump 20 in cooperation with the housing main body 31.

The pump housing 30A is formed with fluid passages including supply/discharge fluid passages of the piston pump 20. Details of the fluid passages will be described later.

As shown in FIGS. 2 and 3, the piston pump 20 includes a pump main body 210 rotatably driven by the pump shaft 10, and a plate 220 formed with a suction opening and a discharge opening of the pump main body 210.

The pump main body 210 includes a cylinder block 211 supported in a relatively non-rotatable manner by the pump shaft 10, and a plurality of pistons 215 accommodated in the cylinder block 211 in a slidable manner along the axis line direction.

The cylinder block 211 has a plurality of cylinder chambers opened to an end surface on a side opposite to the port block 35, and the plurality of pistons 215 is respectively accommodated in the plurality of cylinder chambers in a slidable manner along the axis line direction.

Furthermore, the cylinder block 211 is formed with a plurality of communication ports, which are respectively fluidly connected to the plurality of cylinder chambers, at an end surface facing to the port block 35.

Figure 5:
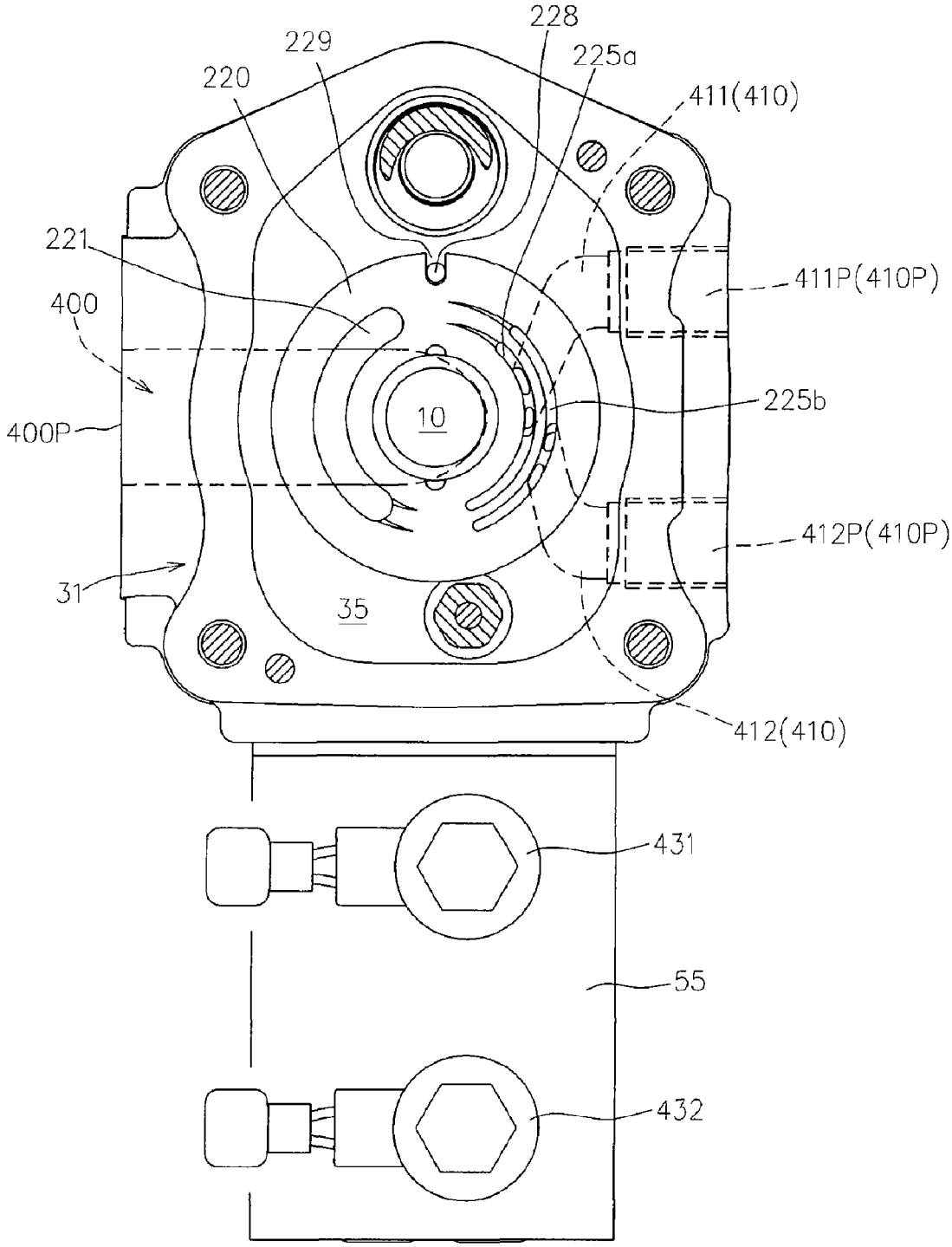
FIG. 5 is an end view taken along line V-V of FIG. 2.

FIG. 5 shows an end view of the plate 220 taken along line V-V of FIG. 2.

As shown in FIG. 5, the plate 220 has a single suction opening 221, and a plurality of a first and a second discharge openings 225*a*, 225*b* in the present embodiment.

In the present embodiment, the piston pump 20 can discharge fluid, which has been sucked in through the single suction opening 221, to two systems through the first and second discharge openings 225*a*, 225*b* by including the plate 220.

As shown in FIGS. 2 and 5, the plate 220 is formed with a concave portion 229 opened radially outward, and the plate 220 is fixed to the port block 35 in a non-rotatable manner about the axis line by engaging a pin 228 into the concave portion 229.

In the present embodiment, the piston pump 20 is a variable displacement type in which supply and discharge fluid amounts of the pump main body 210 can be changed.

Specifically, the piston pump 20 has a movable swash plate 230 defining sliding ranges of the plurality of pistons 215, as shown in FIGS. 2 to 4.

The movable swash plate 230 can swing about a swing axis line orthogonal to the pump shaft 10 while directly or indirectly contacting free ends of the plurality of pistons 215, so that the sliding ranges of the plurality of pistons 215 can be changed according to a tilted position about the swing axis line.

In the present embodiment, the movable swash plate 230 engages the free ends of the plurality of pistons 215 by way of shoes.

Furthermore, the piston pump 20 includes a biasing member 240 for biasing the movable swash plate 230 towards a maximum tilted direction about the swing axis line in the present embodiment, as shown in FIGS. 2, 4, and 5.

Specifically, as shown in FIG. 2, the movable swash plate 230 has an opening 231 through which the pump shaft 10 is inserted, a piston contacting region 232 extending radially outward from the opening 231 and engaged directly or indirectly to the plurality of pistons 215, and a first extending region 233 extending radially outward from the piston contacting region 232.

The biasing member 240 is accommodated in the pump housing 30 so as to be substantially in parallel to the pump shaft 10 with its distal end directly or indirectly engaged to the first extending region 233.

In the present embodiment, the piston pump 20 is configured such that an initial biasing force of the biasing member 240 can be adjusted by manual operation.

Specifically, a coil spring is used as the biasing member 240 in the present embodiment, as shown in FIG. 2.

The coil spring has a distal end engaged to the first extending region 233 of the movable swash plate 230 by way of a first spring receiving member 241, and a proximal end engaged to a second spring receiving member 242 that is accommodated liquid tightly and slidably in the axis line direction within a pass-through hole formed in the port block 35.

The fluid passage block 50 connected to the port block 35 is provided with a manual operation member 245, which has a distal end engaged to the second spring receiving member 242 and a proximal end extending outward, at a region corresponding to the pass-through hole.

The manual operation member 245 is capable of changing an axial position thereof, and an axial position of the second spring receiving member 242 can be changed by changing the axial position of the manual operation member 245, whereby the initial biasing force of the coil spring could be adjusted.

A bolt and a nut are used as the manual operation member 245 in the present embodiment.

The swing axis line of the movable swash plate 230 is displaced towards a side closer to the biasing member 240 with the axis line of the pump shaft 10 as a reference.

According to such a configuration, when discharge pressure of the pump main body 210 rises as rotation number of the pump shaft 10 increases, the movable swash plate 230 accordingly is tilted towards a neutral side against the biasing force of the biasing member 240 by way of the plurality of pistons 215.

Therefore, the discharge pressure of the pump main body 210 can be effectively prevented from rising to an unnecessary pressure due to increase in rotation number of the pump shaft 10.

The trochoid pump 40 is arranged coaxially with piston pump 20 so as to be operatively driven by the pump shaft 10.

Specifically, the trochoid pump 40 is operatively driven by the pump shaft 10 in a state of being accommodated in a concave portion 45 formed in one or both contacting surfaces of the pump housing 30 and the fluid passage block 50.

In the present embodiment, the fluid passage block 50 is connected to the port block 35 as described above. In this embodiment, the concave portion 45 is formed in one or both contacting surfaces of the port block 35 and the fluid passage block 50.

As shown in FIGS. 2 and 3, the concave portion 45 is formed in the port block 35 in the present embodiment, and the trochoid pump 40 is driven by the pump shaft 10 in a state of being accommodated in the concave portion 45 formed in the port block 35.

The fluid passage block 50 is removably connected to the port block 35 so as to close in a liquid-tight manner the concave portion 45, as shown in FIGS. 2 and 3.

A detailed configuration of the fluid passage block 50 will be described later.

The gear pump 60 is arranged coaxially with the piston pump 20 and the trochoid pump 40 so as to be operatively driven by the pump shaft 10.

As shown in FIGS. 2 and 3, in the present embodiment, a rotation shaft 65 is connected to the second end 12 of the pump shaft 10 in a relatively non-rotatable manner about the axis line by way of a coupling 66.

The gear pump 60 is driven by the rotation shaft 65.

The gear pump case 70 is removably connected to an end surface on a side opposite to the port block 35 of the fluid passage block 50 so as to surround the gear pump 60.

The fluid passage formed in the pump housing 30 will now be described below.

The pump housing 30 is provided with a suction fluid passage 400 having a first end opened to an outer surface to form a suction port 400P, and a piston pump discharge fluid passage 410 having a proximal end fluidly connected to the discharge opening of the piston pump 20 and a distal end opened to the outer surface to form a piston pump discharge port 410P.

As shown in FIGS. 3 and 5, the suction fluid passage 400 and the piston pump discharge fluid passage 410 are formed in the port block 35 in the present embodiment.

As shown in FIG. 3, the suction fluid passage 400 is configured to guide hydraulic fluid, which has been introduced through the suction port 400P, to the suction opening 221 of the piston pump 20, and also guides the hydraulic fluid to a suction opening 41 of the trochoid pump 40 and a suction opening 61 of the gear pump 60.

Specifically, the suction fluid passage 400 has a second end branched into three fluid passages of a piston pump suction fluid passage 402, a trochoid pump suction fluid passage 403, and a gear pump branched fluid passage 404, as shown in FIG. 3.

That is, the suction fluid passage 400 includes a main fluid passage 401 having a first end opened to the outer surface of the port block 35 to form the suction port 400P, and the piston pump suction fluid passage 402, the trochoid pump suction fluid passage 403 and the gear pump branched fluid passage 404 each having a proximal end fluidly connected to the main fluid passage 401.

The main fluid passage 401 extends in a direction substantially orthogonal to the pump shaft 10.

The piston pump suction fluid passage 402 extends in a direction substantially orthogonal to the main fluid passage 401 in a state of having the proximal end fluidly connected to the main fluid passage 401 and a distal end fluidly connected to the suction opening 221 of the plate 220.

The trochoid pump suction fluid passage 403 extends in a direction identical to the main fluid passage 401 in a state of having the proximal end fluidly connected to the main fluid passage 401 and a distal end fluidly connected to the first suction opening 41 that is provided in an end surface on a side close to the piston pump 20 of the trochoid pump 40.

The gear pump branched fluid passage 404 extends in a direction substantially orthogonal to the main fluid passage 401 in a state of having the proximal end fluidly connected to the main fluid passage 401 and a distal end opened to a contacting surface with the fluid passage block 50.

As described above, the piston pump 20 has first and second discharge openings 225*a*, 225*b*.

Therefore, the piston discharge fluid passage 410 includes a piston pump first discharge fluid passage 411 having a proximal end fluidly connected to the first discharge opening 225*a* and a distal end opened to an outer surface to form a piston pump first discharge port 411P, and a piston pump second discharge fluid passage 412 having a proximal end fluidly connected to the second discharge opening 225*b* and a distal end opened to an outer surface to form a piston pump second discharge port 412P, as shown in FIGS. 4 and 5.

The detailed configuration of the fluid passage block 50 will now be described.

Figure 6:
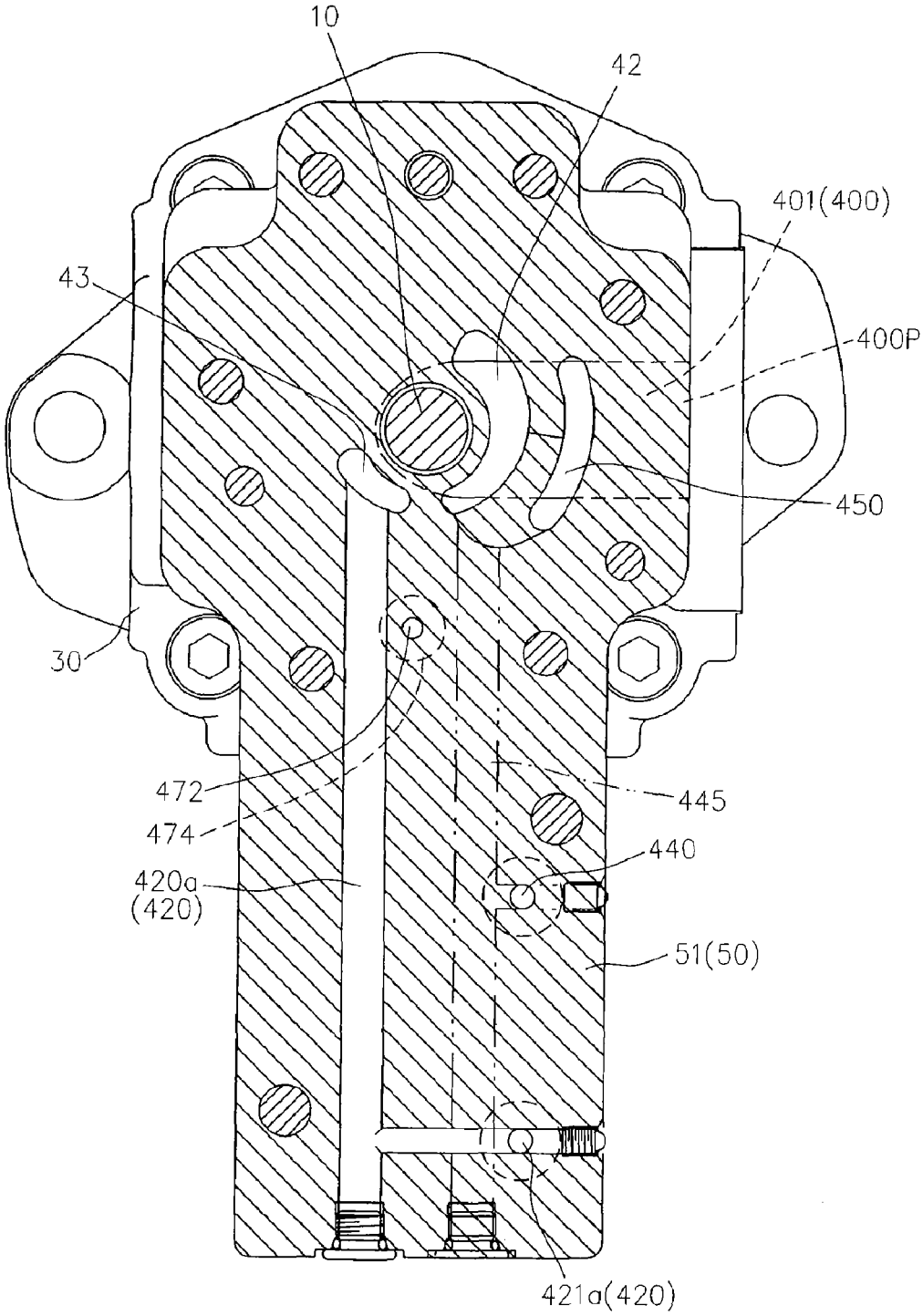
FIG. 6 is a cross sectional view taken along line VI-VI of FIG. 2.
Figure 7:
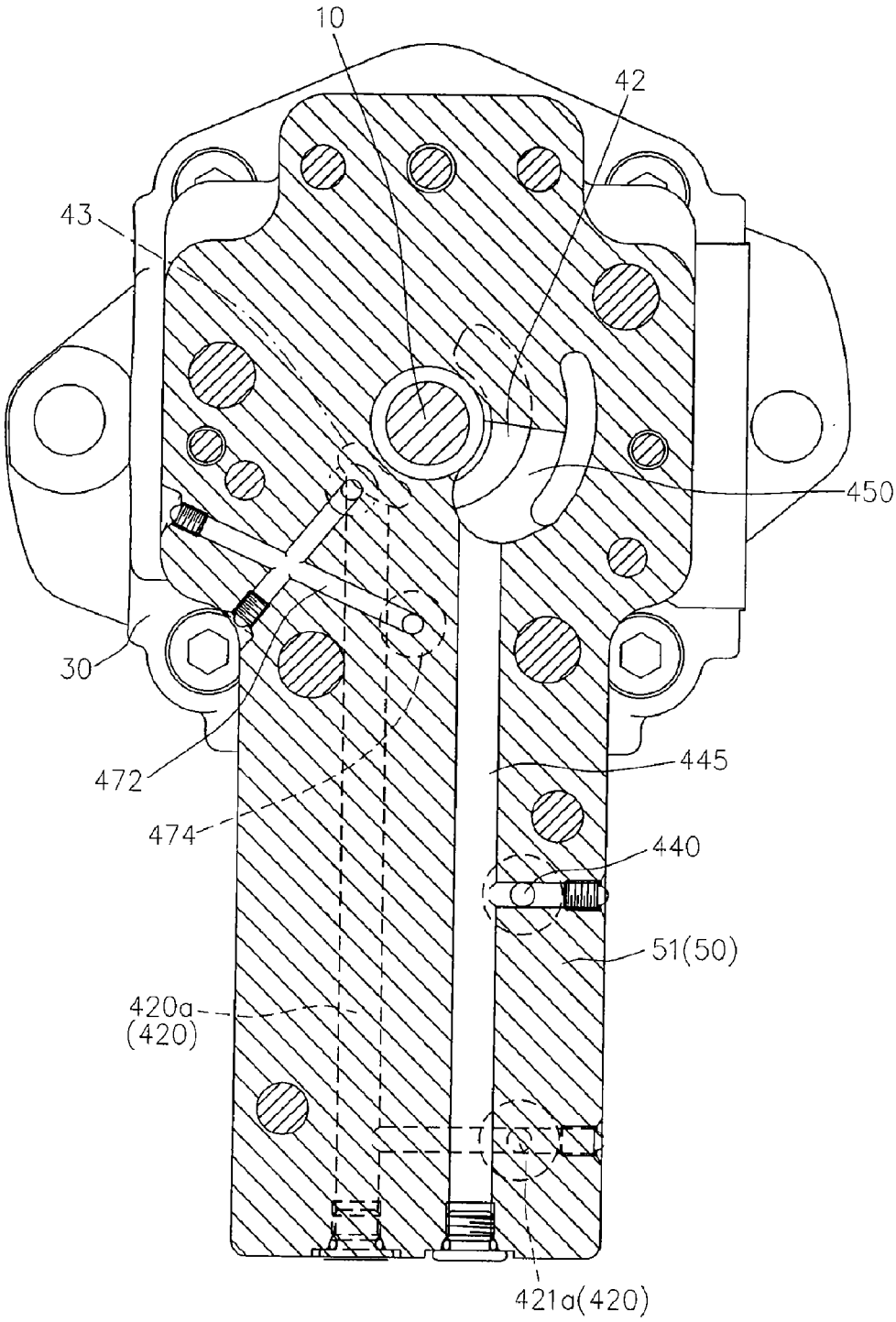
FIG. 7 is a cross sectional view taken along line VII-VII of FIG. 2.

FIGS. 6 and 7 show cross sectional views of the fluid passage block 50 taken respectively along line VI-VI and line VII-VII of FIG. 2.

As shown in FIGS. 3 and 6, the fluid passage block 50 is formed with a trochoid pump discharge fluid passage 420 having a proximal end fluidly connected to a discharge opening 43 of the trochoid pump 40 and a distal end opened to an outer surface to form a trochoid pump discharge port 420P (see FIGS. 2 and 4).

As described above, in the present embodiment, the trochoid pump 40 is accommodated in the concave portion 45 formed in one or both contacting surfaces (the contacting surface with the fluid passage block 50 of the port block 35 in the illustrated embodiment) of the pump housing 30 (the port block 35 in the illustrated embodiment) and the fluid passage block 50, the fluid passage block 50 is connected to the pump housing 30 so as to close in a liquid-tight manner the concave portion 45, and the fluid passage block 50 is formed with the trochoid pump discharge port 420P fluidly connected to the trochoid pump 40 functioning as the hydraulic source.

According to such a configuration, it is possible to change specification from one mode where the trochoid pump 40 is provided to the other mode where the trochoid pump 40 is omitted by simply replacing the fluid passage block 50 with a blocking plate (not shown) for closing in a liquid-tight manner the concave portion 45 while using the pump housing 30 as it is.

Therefore, pump units corresponding to various specifications could be easily obtained while using common components as much as possible.

Furthermore, in the present embodiment, as described above, the trochoid pump suction fluid passage 403 is branched from the main fluid passage 401 formed in the pump housing 30 (the port block 35 in the illustrated embodiment) along with the piston pump suction fluid passage 402.

Therefore, it is possible to change specification from the one mode where the trochoid pump 40 is provided to the other mode where the trochoid pump 40 is not provided by simply replacing the fluid passage block 50 with the blocking plate without changing suction-side conduits fluidly connected to the suction port 400P.

Moreover, in the present embodiment, valves 431, 432 for controlling a discharge state of the trochoid pump discharge port 420P are mounted to the fluid passage block 50, as shown in FIGS. 1, 2, and 4.

Specifically, in the present embodiment, the fluid passage block 50 includes a fluid passage plate 51 removably connected to the pump housing 30, and a valve block 55 removably connected to the fluid passage plate 51, as shown in FIGS. 1 and 2.

Figure 8:
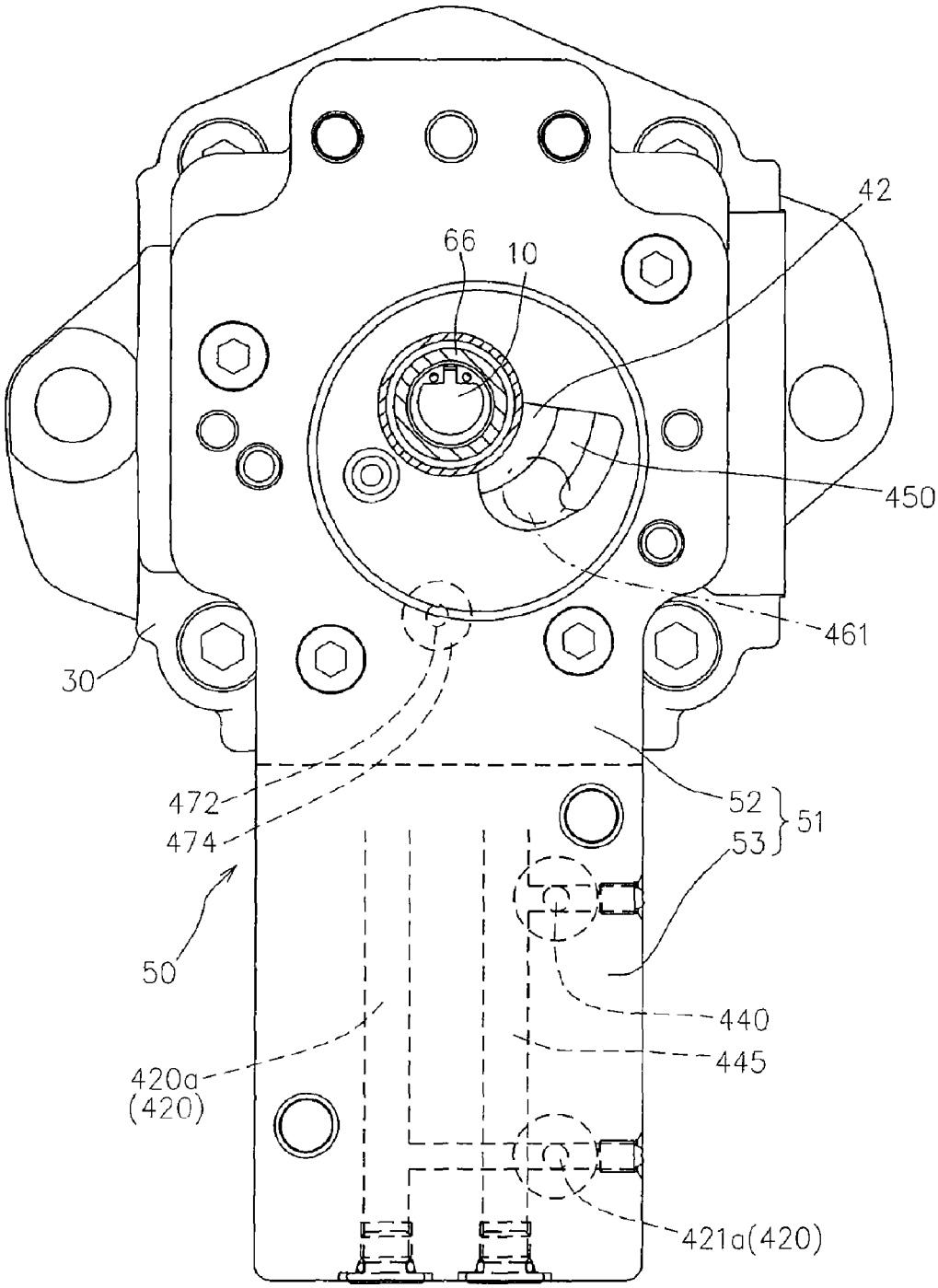
FIG. 8 is an end view taken along line VIII-VIII of FIG. 2.
Figure 9:
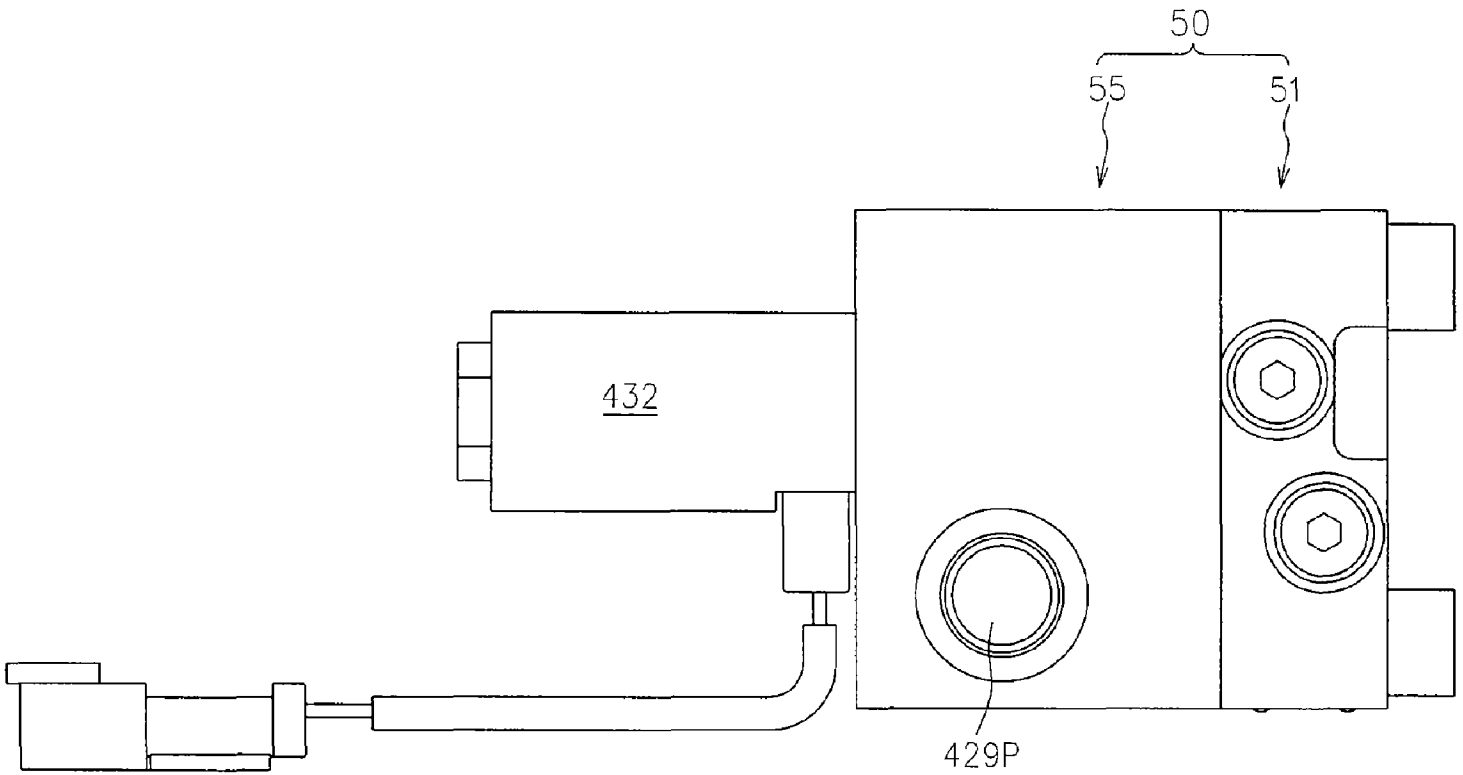
FIG. 9 is an end view taken along line IX-IX of FIG. 2.

FIGS. 8 and 9 show end views taken respectively along line VIII-VIII and line IX-IX of FIG. 2.

As shown in FIGS. 1, 2, and 6 to 8, the fluid passage plate 51 has a contacting portion 52 contacting the pump housing 30, and an extending portion 53 extending radially outward from the contacting portion 52 with the axis line of the pump shaft 10 as the reference.

The valve block 55 is connected to the extending portion 53, as shown in FIGS. 1 and 2.

Preferably, the valve block 55 is connected to an end surface identical to an end surface contacting the pump housing 30, out of end surfaces of the fluid passage plate 51.

According to such a configuration, the valve block 55 can be arranged in a dead space defined by the flywheel housing 5, the pump housing 30, and the fluid passage plate 51 (see FIG. 1).

The fluid passage plate 51A is formed with a fluid passage plate-side discharge fluid passage 420*a* forming a part of the trochoid pump discharge fluid passage 420.

The fluid passage plate-side discharge fluid passage 420*a* has a proximal end fluidly connected to the discharge opening 43 of the trochoid pump 40 and a distal end opened to a contacting surface with the valve block 55, as shown in FIG. 6.

As shown in FIGS. 1 and 2, in the present embodiment, the valve block 55 is provided with trochoid first to third discharge ports 421P to 423P as the trochoid pump discharge port 420P.

Specifically, as shown in FIG. 4, the valve block 55 is provided with a first branched fluid passage 421*a* having a first end opened to a contacting surface with the fluid passage plate 51 to fluidly connect to the fluid passage plate-side discharge fluid passage 420*a*, a first discharge fluid passage 421*b* having a first end opened to an outer surface to form the first discharge port 421P, a first switching valve 431 for selectively communicating or shutting off between the first branched fluid passage 421*a* and the first discharge fluid passage 421*b*, a second branched fluid passage 422*a* having a first end fluidly connected to the first branched fluid passage 421*a* by way of a check valve 435, a second discharge fluid passage 422*b* having a first end opened to the outer surface to form the second discharge port 422P, a second switching valve 432 for selectively communicating or shutting off between the second branched fluid passage 422*a* and the second discharge fluid passage 422*b*, and a third branched fluid passage 423*a* having a first end fluidly connected to the second branched fluid passage 422*a* and a second end opened to the outer surface to form the third discharge port 423P.

In such a configuration, the first branched fluid passage 421*a*, the first discharge fluid passage 421*b*, the second branched fluid passage 422*a*, the second discharge fluid passage 422*b* and the third branched fluid passage 423*a* faun the trochoid pump discharge fluid passage 420 together with the fluid passage plate-side discharge fluid passage 420*a*.

The first to third discharge ports 421P, 422P and 423P are preferably provided on a same surface (see FIG. 1).

According to such a configuration, piping workability of connecting conduits to the first to third discharge ports 421P, 422P, and 423P can be improved.

Furthermore, a relief valve 438 for setting hydraulic pressure of the trochoid pump discharge fluid passage 420 is mounted to the valve block 55 in the present embodiment.

Specifically, as shown in FIG. 4, the valve block 55 is formed with a hydraulic pressure setting fluid passage 425 having a first end fluidly connected to the first branched fluid passage 421*a*, and the relief valve 438 is interposed in the hydraulic pressure setting fluid passage 425.

A second end of the hydraulic pressure setting fluid passage 425 is fluidly connected to a valve block-side return fluid passage 440 formed in the valve block 55 so as to open to a contacting surface with the fluid passage plate 51.

The valve block-side return fluid passage 440 is fluidly connected to the suction openings of the trochoid pump 40 and the gear pump 60 by way of a fluid passage plate-side return fluid passage 445 and a communication fluid passage 450 (see FIGS. 6 and 7) formed in the fluid passage plate 51.

A detailed configuration of the communication fluid passage 450 will be described later.

In the present embodiment, the first switching valve 431 is configured so as to take a hydraulic fluid discharging state of fluidly connecting the first branched fluid passage 421*a* to the first discharge fluid passage 421*b* to discharge hydraulic fluid through the first discharge port 421P, and a hydraulic fluid returning state of returning return fluid, which has been brought in through the first discharge port 421P, to the valve block-side return fluid passage 440.

Similarly, the second switching valve 432 is configured to take a hydraulic fluid discharging state of fluidly connecting the second branched fluid passage 422*a* to the second discharge fluid passage 421*b* to discharge hydraulic fluid through the second discharge port 422P, and a hydraulic fluid returning state of returning return fluid, which has been brought in through the second discharge port 422P, to the valve block-side return fluid passage 440.

Specifically, the valve block 55 is further formed with a first return fluid passage 441 having a first end fluidly connected to a primary side of the first switching valve 431 and a second end fluidly connected to the valve block-side return fluid passage 440, and a second return fluid passage 442 having a first end fluidly connected to a primary side of the second switching valve 432 and a second end fluidly connected to the valve block-side return fluid passage 440.

The first switching valve 431 is configured so as to selectively take a discharging position of fluidly connecting the first branched fluid passage 421*a* to the first discharge fluid passage 421*b* and blocking the first end of the first return fluid passage 441, and a returning position of blocking a second end of the first branched fluid passage 421*a* and fluidly connecting the first discharge fluid passage 441 to the first return fluid passage 421*b*.

Similarly, the second switching valve 432 is configured so as to selectively take a discharging position of fluidly connecting the second branched fluid passage 422*a* to the second discharge fluid passage 422*b* and blocking the first end of the second return fluid passage 442, and a returning position of blocking a second end of the second branched fluid passage 422*a* and fluidly connecting the second discharge fluid passage 442*b* to the second return fluid passage 442.

In the present embodiment, the valve block 55 is further formed with a fourth branched fluid passage 429 having a first end fluidly connected to the first branched fluid passage 421*a* and a second end opened to an outer surface to form a gauge port 429P, as shown in FIGS. 4 and 9.

The gauge port 429P may be used to measure discharge pressure of the trochoid pump 40.

Figure 10:
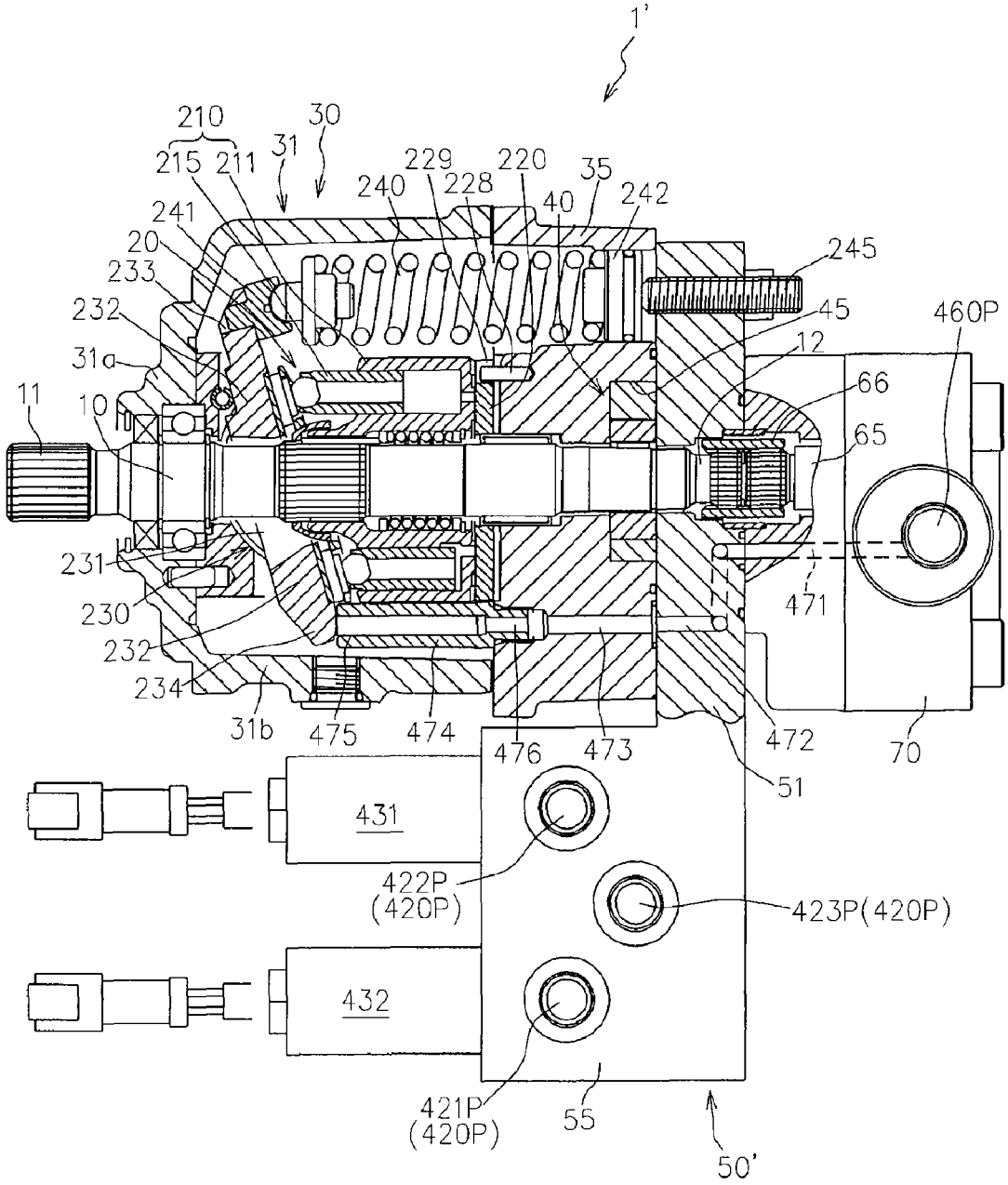
FIG. 10 is a cross sectional view of a multiple pump unit modified from the multiple pump unit according to the first embodiment.

In the present embodiment, the fluid passage block 50 is formed by the fluid passage plate 51 and the valve block 55 that are separate bodies from each other, and the valves 431, 432 are attached to the valve block 55, as described above. Alternatively, a fluid passage block 50' integrally including the fluid passage plate 51 and the valve block 55 may be provide, and the valves 431, 432 may be attached to the single fluid passage block 50', as shown in FIG. 10.

The communication fluid passage 450 formed in the fluid passage plate 51 will now be described.

As shown in FIG. 3, the communication fluid passage 450 has a first end opened to a contacting surface with the port block 35 so as to be fluidly connected to a distal end of the gear pump branched fluid passage 404.

A second end of the communication fluid passage 450 is opened to a contacting surface with the gear pump case 70 while being fluidly connected to a second suction opening 42 provided on a side opposite to the first suction opening 41 in the trochoid pump 40.

That is, the communication fluid passage 450 is configured so as to guide fluid, which has been sent from the gear pump branched fluid passage 404, to the second suction opening 42 of the trochoid pump 40 and the suction opening 61 of the gear pump 60.

The fluid passage plate-side return fluid passage 445 has a first end opened to a contacting surface with the valve block 55 so as to be fluidly connected to the valve block-side return fluid passage 440, and a second end fluidly connected to the communication fluid passage 450 (see FIGS. 6 and 7).

The fluid passages formed in the gear pump case 70 will now be described.

As shown in FIGS. 3 and 4, the gear pump case 70 is formed with a gear pump suction fluid passage 461 having a first end opened to a contacting surface with the fluid passage block 50 so as to be fluidly connected to the communication fluid passage 450 and a second end fluidly connected to the suction opening 61 of the gear pump 60, and a gear pump discharge fluid passage 462 having a first end opened to an outer surface to form a gear pump discharge port 460P.

In the present embodiment, at least a part of the concave portion 45 for accommodating the trochoid pump 40 is formed in the pump housing 30, as described above.

In such an embodiment, the first end of the third pump suction fluid passage 461 is preferably arranged so as to overlap at least one of the concave portion 45 and the second end of the third pump branched fluid passage 404 when seen along the axis line direction of the pump shaft 10.

According to such a configuration, in a case where the trochoid pump 40 is not necessary, it is possible to easily change specification to a mode where only the piston pump 20 and the gear pump 60 are provided by simply removing the trochoid pump 40 and the fluid passage block 50 and then connecting the gear pump case 70 to the pump housing 30.

All the discharge ports including the piston pump first and second discharge ports 411P, 412P, the trochoid pump first to third discharge ports 421P, 422P, 423P and the gear pump discharge port 460P are preferably provided on a same side surface of the multiple pump unit 1 (see FIG. 1).

According to such a configuration, piping workability in connecting external conduits to the discharge ports can be enhanced and an efficient layout of the external conduits can be obtained.

Furthermore, the movable swash plate 230 biased towards a maximum tilted direction by the biasing member 240 is configured so as to be tilted towards a neutral side according to rise in discharge pressure of the gear pump 60 as well as rise in discharge pressure of the piston pump 20 in the present embodiment.

That is, the multiple pump unit 1 has a neutral-side return line 470 for causing discharge pressure of the gear pump 60 to act on the movable swash plate 230 in addition to the above configurations as shown in FIG. 4.

Specifically, the movable swash plate 230 has a second extending region 234 on a side opposite to the first extending region 233 with the pump shaft 10 as the reference, as shown in FIG. 2.

As shown in FIGS. 2 and 3, the neutral-side return line 470 includes a gear pump case-side neutral return fluid passage 471 formed in the gear pump case 70 so as to have a proximal end fluidly connected to the gear pump discharge fluid passage 462 and a distal end opened to a contacting surface with the fluid passage block 50, a fluid passage block-side neutral return fluid passage 472 formed in the fluid passage block 50 so as to have a proximal end opened to a contacting surface with the gear pump case 70 to be fluidly connected to the pump case-side neutral return fluid passage 471 and a distal end opened to a contacting surface with the port block 35, a port block-side neutral return fluid passage 473 formed in the port block 35 so as to have a proximal end opened to a contacting surface with the fluid passage block 50 to be fluidly connected to the fluid passage block-side neutral return fluid passage 472 and a distal end opened into an internal space of the pump housing 30, a conduit member 474 including a fluid passage that has an proximal end fluidly connected to the port block-side neutral return fluid passage 473 and a distal end opened towards the second extending region 234, and a pushing member 475 accommodated in the fluid passage of the conduit member 474 in a slidable manner along the axis line direction with its distal end engaged to the second extending region 234 of the movable swash plate 230.

A plug with throttle hole 476 is interposed in the fluid passage of the piping member 474.

Second Embodiment

Another embodiment of the multiple pump unit according to the present invention will now be described with reference to the attached drawings.

Figure 11:
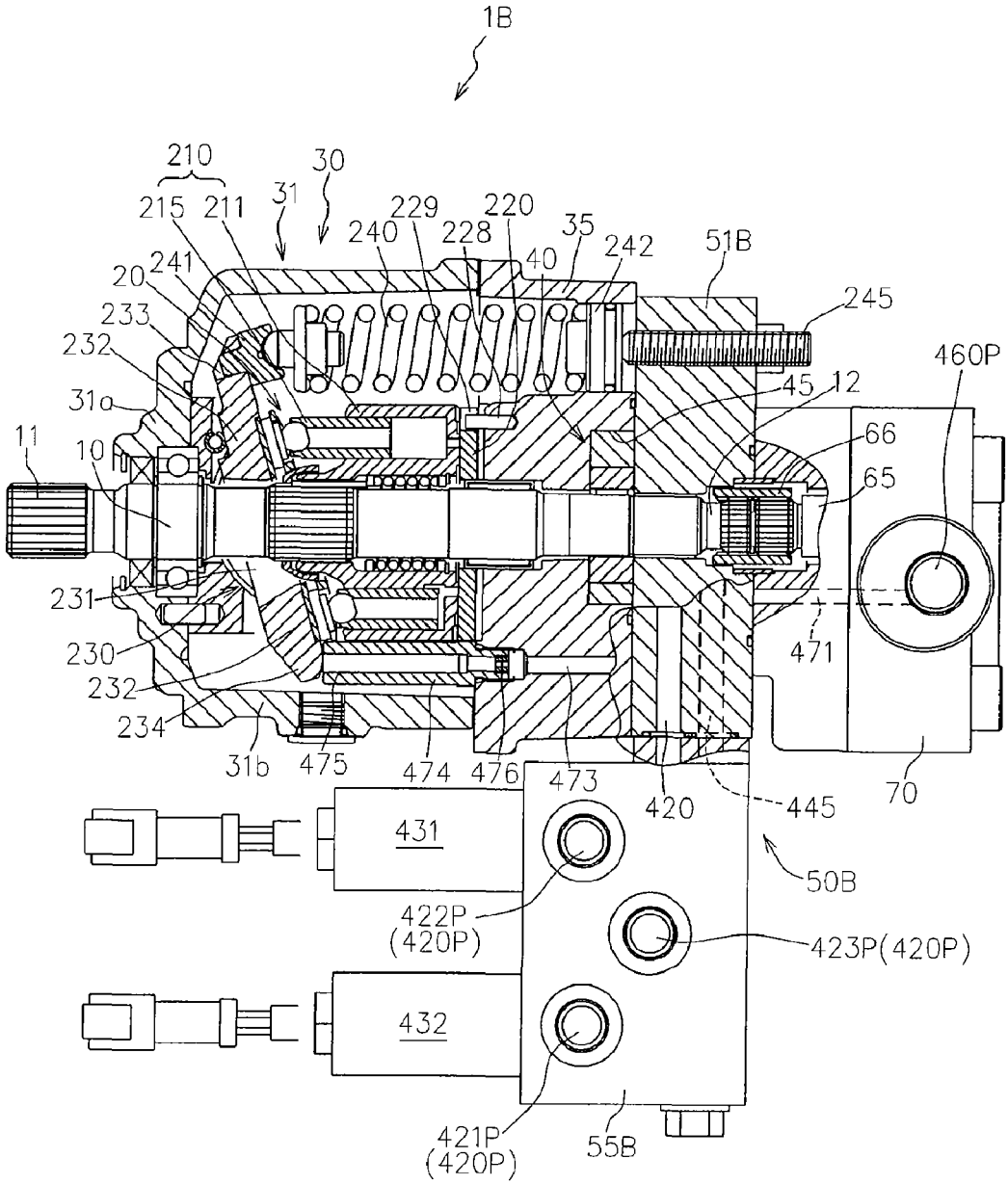
FIG. 11 is a cross sectional view of a multiple pump unit according to a second embodiment of the present invention.

FIG. 11 is a cross sectional view, which corresponds to FIG. 2, of a multiple pump unit 1B according to the present embodiment.

In the drawing, the same reference characters are denoted for the same members as in the first embodiment, and the detailed explanations thereof are omitted.

The multiple pump unit 1B according to the present embodiment includes a fluid passage block 50B in place of the fluid passage block 50 with respect to the multiple pump unit 1 according to the first embodiment, as shown in FIG. 11.

The fluid passage block 50B includes a fluid passage plate 51B having a substantially same configuration as the contacting portion 52 of the fluid passage plate 51, and a valve block 55B having a substantially same configuration as the valve block 55, the valve block 55B being detachably connected to an end surface, which faces in a direction orthogonal to the axial line direction of the pump shaft 10, of the fluid passage plate 51B.

In the thus configured multiple pump unit 1B, it is also possible to change specification from one mode where the trochoid pump 40 is provided to the other mode where the trochoid pump 40 is omitted by simply replacing the fluid passage block 50B with the blocking plate (not shown) for liquid-tightly closing the concave portion 45 while using the pump housing 30 as it is.

Therefore, pump units corresponding to various specifications could be easily obtained while using common components as much as possible.

Further, as similarly to the first embodiment, the multiple pump unit 1B may be configured so that the piston pump 20, the trochoid pump 40 and the gear pump 60 suck the operation fluid through the common suction fluid passage 400, and furthermore all the discharge ports including the piston pump first and second discharge ports 411P, 412P, the trochoid pump first to third discharge ports 421P, 422P, 423P and the gear pump discharge port 460P face towards the same direction as shown in FIG. 11.

According to such a configuration, efficiency of piping workability in connecting external conduits to the suction fluid passage and the discharge ports can be improved, and an efficient layout of the external conduits can be obtained.

Furthermore, as similarly to the first embodiment, the multiple pump unit 1B is configured so that the valve block 55B in which the trochoid pump first to third discharge ports 421P, 422P, 423P are provided and to which the valves 431, 432 are mounted is detachably connected to the fluid passage plate 51B.

Therefore, it is possible to easily change the number of the second pump discharge port by replacing the fluid passage block without changing the other components.

Third Embodiment

Still another embodiment of the multiple pump unit according to the present invention will now be described with reference to the attached drawings.

Figure 12:
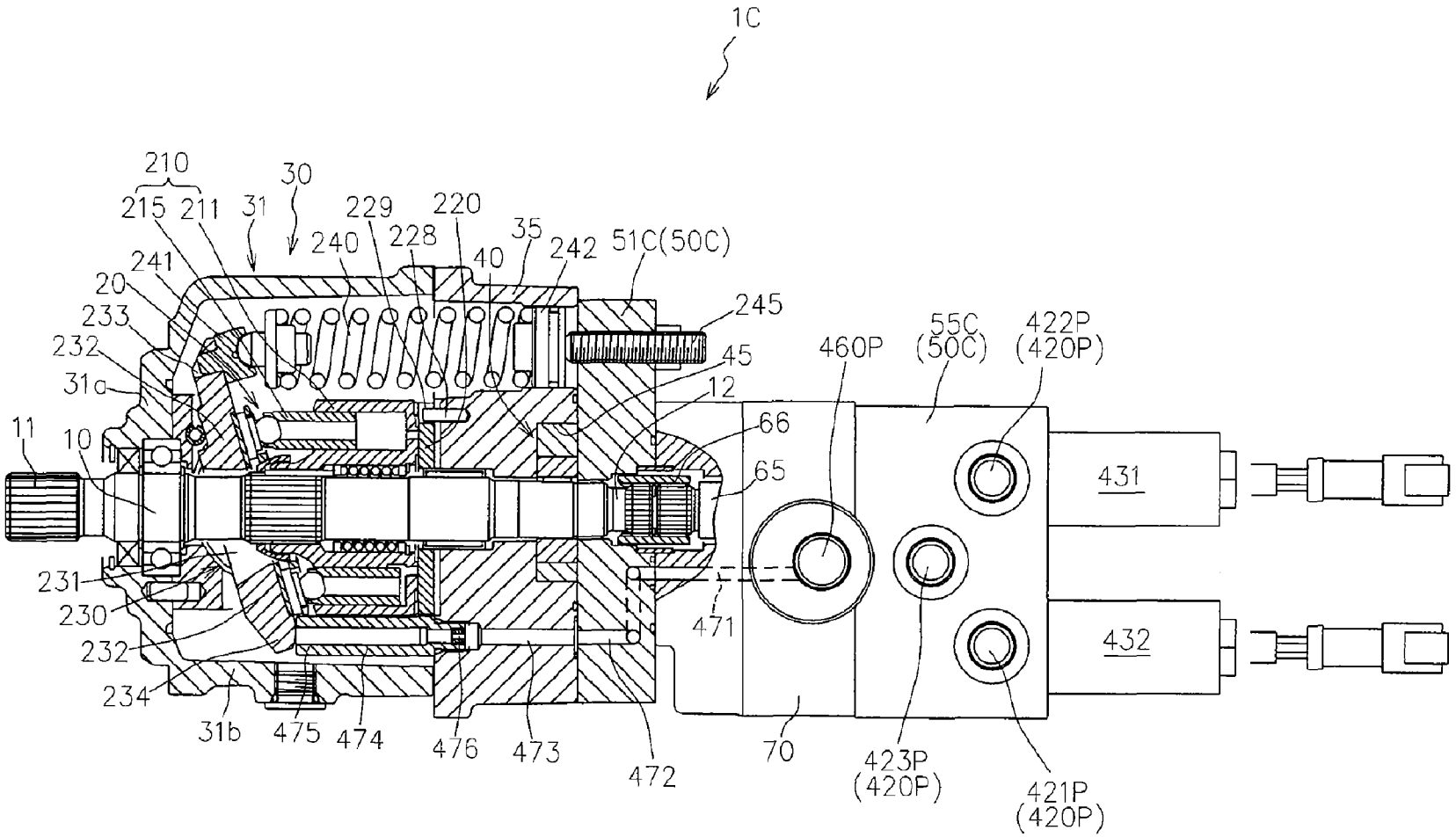
FIG. 12 is a cross sectional view of a multiple pump unit according to a third embodiment of the present invention.

FIG. 12 is a cross sectional view, which corresponds to FIG. 2, of a multiple pump unit 1C according to the present embodiment.

In the drawing, the same reference characters are denoted for the same members as in the first and second embodiments, and the detailed explanations thereof are omitted.

The multiple pump unit 1C according to the present embodiment includes a fluid passage block 50C in place of the fluid passage block 50 with respect to the multiple pump unit 1 according to the first embodiment, as shown in FIG. 12.

The fluid passage block 50C includes a fluid passage plate 51C detachably connected to the pump housing 30, and a valve block 55C in which the trochoid pump first to third discharge ports 421P, 422P, 423P are provided and to which the valves 431, 432 are mounted.

The fluid passage plate 51C is detachably connected to the pump housing 30 so as to accommodate the trochoid pump 40 between the fluid passage plate 51C and the pump housing 30, as similarly to the above embodiments.

In the present embodiment, the fluid passage plate 51C has a shape corresponding to the pump housing 30 when seen along the axis line direction of the pump shaft 10.

The valve block 55C is detachably connected to an end surface on a side opposite to the fluid passage plate 51C of the gear pump case 70.

In the present embodiment, the trochoid pump discharge fluid passage 420 is foamed so as to extend over the fluid passage plate 51C, the gear pump case 70 and the valve block 55C.

In the thus configured multiple pump unit 1C, it is also possible to change specification from one mode where the trochoid pump 40 is provided to the other mode where the trochoid pump 40 is omitted by simply replacing the fluid passage plate 51C with the blocking plate (not shown) for liquid-tightly closing the concave portion 45 while using the pump housing 30 as it is.

Therefore, pump units corresponding to various specifications could be easily obtained while using common components as much as possible.

Further, as similarly to the first and second embodiments, the multiple pump unit 1C may be configured so that the piston pump 20, the trochoid pump 40 and the gear pump 60 suck the operation fluid through the common suction fluid passage 400, and furthermore all the discharge ports including the piston pump first and second discharge ports 411P, 412P, the trochoid pump first to third discharge ports 421P, 422P, 423P and the gear pump discharge port 460P face towards the same direction as shown in FIG. 12.

According to such a configuration, efficiency of piping workability in connecting external conduits to the suction fluid passage and the discharge ports can be improved, and an efficient layout of the external conduits can be obtained.

Furthermore, the multiple pump unit 1C is configured so that the valve block 55C in which the trochoid pump first to third discharge ports 421P, 422P, 423P are provided and to which the valves 431, 432 are mounted is detachably connected to the gear pump case 70.

Therefore, it is possible to easily change the number of the trochoid pump discharge ports only by replacing the valve block 55C.

Fourth Embodiment

Still another embodiment of the multiple pump unit according to the present invention will now be described with reference to the attached drawings.

Figure 13:
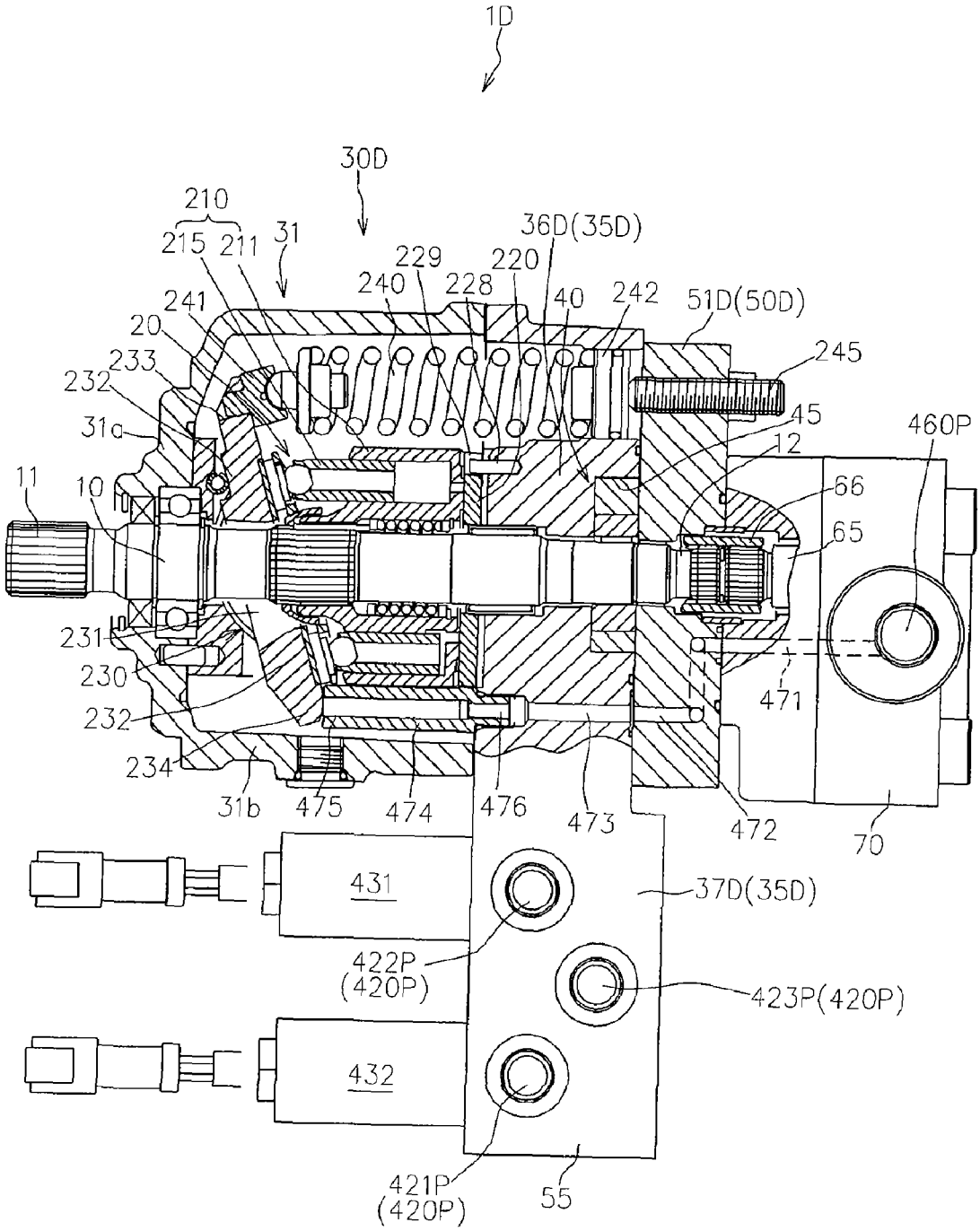
FIG. 13 is a cross sectional view of a multiple pump unit according to a fourth embodiment of the present invention.

FIG. 13 is a cross sectional view, which corresponds to FIG. 2, of a multiple pump unit 1D according to the present embodiment.

In the drawing, the same reference characters are denoted for the same members as in the first to third embodiments, and the detailed explanations thereof are omitted.

The multiple pump unit 1D is different from the multiple pump units 1-1C according to the first to third embodiments in that the trochoid pump first to third discharge ports 421P, 422P, 423P are provided in a pump housing 30D for accommodating the piston pump 20.

Specifically, the multiple pump unit 1D includes the pump housing 30D in place of the pump housing 30 and a fluid passage block 50D in place of the fluid passage block 50 with respect to the multiple pump unit 1 according to the first embodiment.

As shown in FIG. 13, the pump housing 30D includes the housing main body 31, and a port block 35D detachably connected to the housing main body 31 so as to close the opening 31*c* of the housing main body 31.

The port block 35D includes a contacting portion 36D contacting the housing main body 31 while closing the opening 31*c*, and an extending portion 37D extending radially outward from the contacting portion 36D with the axis line of the pump shaft 10 as the reference.

The port block 35D is formed with the trochoid pump discharge fluid passage 420 in addition to the suction fluid passage 400 and the piston pump discharge fluid passage 410.

The trochoid pump discharge fluid passage 420 has a proximal end fluidly connected to the discharge opening of the trochoid pump 40 that is accommodated between the contacting portion 36D and the fluid passage block 50D, and a distal end opened to an outer surface of the extending portion 37D to form the trochoid pump discharge port 420P.

Further, in the present embodiment, the valves 431, 432 are mounted on the extending portion 37D as shown in FIG. 13.

The fluid passage block 50D includes a fluid passage plate 51D detachably connected to the pump housing 30D.

The fluid passage plate 51D is detachably connected to the port block 35D while accommodating the trochoid pump 40 between the fluid passage plate 51D and the port block 35D.

As similarly to the first and second embodiments, the multiple pump unit 1D is configured so that the piston pump 20, the trochoid pump 40 and the gear pump 60 suck the operation fluid through the common suction fluid passage 400, and all the discharge ports including the piston pump first and second discharge ports 411P, 412P, the trochoid pump first to third discharge ports 421P, 422P, 423P and the gear pump discharge port 460P face towards the same direction.

Therefore, efficiency of piping workability in connecting external conduits to the suction fluid passage and the discharge ports can be improved, and an efficient layout of the external conduits can be obtained.

Figure 14:
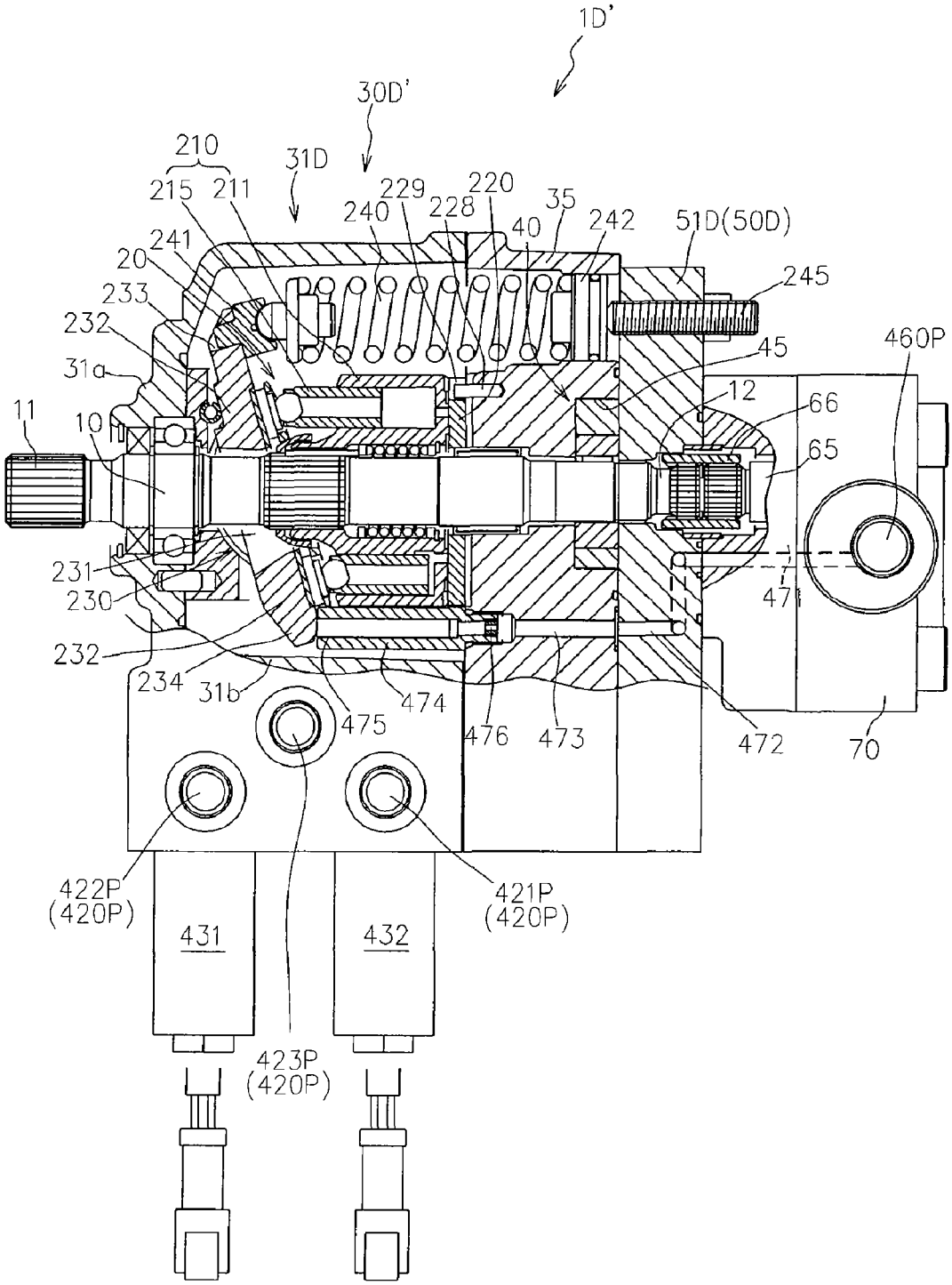
FIG. 14 is a cross sectional view of a multiple pump unit modified from the multiple pump unit according to the fourth embodiment.

In the present embodiment, the trochoid pump first to third discharge ports 421P, 422P, 423P are provided in the port block 35D. Alternatively, the trochoid pump first to third discharge ports 421P, 422P, and 423P may be provided in the housing main body 31D, as shown in FIG. 14.

This specification is by no means intended to restrict the present invention to the preferred embodiments or modified embodiments set forth therein. Various modifications to the multiple pump unit may be made by those skilled in the art without departing from the spirit and scope of the present invention as defined in the appended claims.

The invention claimed is:

1. A multiple pump unit comprising:

a pump shaft operatively connected to a driving power source;

a first pump driven by the pump shaft;

a pump housing for accommodating the first pump;

a second pump operatively driven by the pump shaft;

a fluid passage block connected to one end surface in an axis line direction of the pump housing;

a third pump arranged on a side opposite to the first pump in the axis line of the pump shaft with the second pump as a reference, the third pump being operatively driven by the pump shaft; and a third pump housing connected to an outer surface of the fluid passage block so as to surround the third pump, wherein one or both contacting surfaces of the pump housing and the fluid passage block is/are formed with a concave portion for accommodating the second pump, wherein the pump housing is provided with a suction fluid passage having a first end opened to an outer surface to form a suction port, the suction fluid passage guiding hydraulic fluid, which has been introduced through the suction port, to a suction opening of the first pump, and a first pump discharge fluid passage having a proximal end fluidly connected to a discharge opening of the first pump and a distal end opened to an outer surface to form a first pump discharge port, wherein the fluid passage block is provided with a second pump discharge port having the second pump as a hydraulic source, wherein the suction fluid passage is configured to guide operation fluid, which has been sucked through the suction port, to a first suction opening of the second pump on a side close to the first pump as well as to the suction opening of the first pump, wherein the suction fluid passage includes a third pump branched fluid passage for guiding hydraulic fluid, which has been introduced through the suction port, to a contacting surface with the fluid passage block, wherein the third pump housing is provided with a third pump suction fluid passage having a first end opened to a contacting surface with the fluid passage block and a second end fluidly connected to a suction opening of the third pump, and a third pump discharge fluid passage having a first end fluidly connected to a discharge opening of the third pump and a second end opened to an outer surface to form a third pump discharge port, and wherein the fluid passage block is formed with a communication passage; said communication passage fluidly connects the third pump branched fluid passage to the third pump suction fluid passage, and to a second suction opening of the second pump; said second suction opening being disposed on a side opposite to the first suction opening of the second pump in reference to the axis line of the pump shaft.

2. A multiple pump unit according to claim 1, wherein the fluid passage block is provided with a plurality of the second pump discharge ports, and valves for controlling discharge states of the plurality of second pump discharge ports are mounted to the fluid passage block.

3. A multiple pump unit according to claim 2, wherein the plurality of second pump discharge ports are provided on the same surface of the fluid passage block.

4. A multiple pump unit according to claim 2, wherein the fluid passage block integrally includes a contacting portion contacting the pump housing and a extending portion extending radially outward from the contacting portion with the axis line of the pump shaft as the reference, and the valves are mounted to the extending portion.

5. A multiple pump unit according to claim 4, wherein the fluid passage block includes a valve block detachably connected to an end surface of the extending portion; said end surface facing a direction parallel to the axis line of the pump shaft, and the valves are mounted to the valve block.

6. A multiple pump unit according to claim 2, wherein the fluid passage block includes a fluid passage plate contacting the pump housing, and a valve block which is detachable connected to an end surface facing a direction orthogonal to the axis line of the pump shaft of the fluid passage plate and to which the valves are mounted.

7. A multiple pump unit according to claim 1, wherein the first pump discharge port, the second pump discharge port and the third pump discharge port are arranged on a same surface side of the multiple pump unit.

8. A multiple pump unit according to claim 1, wherein:

at least a part of the concave portion is formed in the pump housing, and the first end of the third pump suction fluid passage is arranged so as to overlap at least one of the concave portion and the second end of the third pump branched fluid passage when seen along the axis line direction of the pump shaft.

9. A multiple pump unit according to claim 1, wherein:

the first pump includes a cylinder block supported by the pump shaft in a relatively non-rotatable manner about the axis line, a plurality of pistons accommodated in the cylinder block in a slidable manner along the axis line, a movable swash plate capable of swinging about a swing axis orthogonal to the pump shaft so as to change sliding ranges of the plurality of pistons according to its tilted position about the swing axis, and a biasing member for biasing the movable swash plate towards a maximum tilted direction about the swing axis;

the biasing member is accommodated in the pump housing so as to be substantially in parallel to the pump shaft with its distal end operatively engaged to the movable swash plate; and the fluid passage block is provided with a manual operation member for changing a position of a proximal end of the biasing member.

10. A multiple pump unit comprising:

a pump shaft operatively connected to a driving power source;

a first pump driven by the pump shaft;

a pump housing for accommodating the first pump;

a second pump operatively driven by the pump shaft;

a fluid passage block connected to one end surface in an axis line direction of the pump housing;

a third pump arranged on a side opposite to the first pump in the axis line of the pump shaft with the second pump as a reference;

the third pump being operatively driven by the pump shaft; and a third pump housing connected to an outer surface of the fluid passage block so as to surround the third pump;

wherein one or both contacting surfaces of the pump housing and the fluid passage block is/are formed with a concave portion for accommodating the second pump;

wherein the pump housing is provided with a suction fluid passage having a first end opened to an outer surface to form a suction port, the suction fluid passage guiding hydraulic fluid, which has been introduced through the suction port, to a suction opening of the first pump, and a first pump discharge fluid passage having a proximal end fluidly connected to a discharge opening of the first pump and a distal end opened to an outer surface to form a first pump discharge port;

wherein the fluid passage block is provided with a second pump discharge port having the second pump as a hydraulic source;

wherein the suction fluid passage is configured to guide operation fluid, which has been sucked through the suction port, to a first suction opening of the second pump on a side close to the first pump as well as to the suction opening of the first pump;

wherein the suction fluid passage includes a third pump branched fluid passage for guiding hydraulic fluid, which has been introduced through the suction port, to a contacting surface with the fluid passage block;

wherein the third pump housing is provided with a third pump suction fluid passage having a first end opened to a contacting surface with the fluid passage block and a second end fluidly connected to a suction opening of the third pump, and a third pump discharge fluid passage having a first end fluidly connected to a discharge opening of the third pump and a second end opened to an outer surface to form a third pump discharge port;

wherein the fluid passage block is formed with a communication passage; said communication passage fluidly connects the third pump branched fluid passage to the third pump suction fluid passage, and to a second suction opening of the second pump; said second suction opening being disposed on a side opposite to the first suction opening of the second pump in reference to the axis line of the pump shaft;

wherein the first pump includes a cylinder block supported by the pump shaft in a relatively non-rotatable manner about the axis line, a plurality of pistons accommodated in the cylinder block in a slidable manner along the axis line, a movable swash plate capable of swinging about a swing axis orthogonal to the pump shaft so as to change sliding ranges of the plurality of pistons according to its tilted position about the swing axis, and a biasing member for biasing the movable swash plate towards a maximum tilted direction about the swing axis;

wherein the biasing member is accommodated in the pump housing so as to be substantially in parallel to the pump shaft with its distal end operatively engaged to the movable swash plate;

wherein the fluid passage block is provided with a manual operation member for changing a position of a proximal end of the biasing member; and wherein discharge pressure of the third pump acts on the movable swash plate so as to tilt the movable swash plate towards a neutral side about the swing axis against the biasing force of the biasing member.

* * * * *